United States Patent [19]

Spitz

[11] Patent Number: 4,633,623

[45] Date of Patent: Jan. 6, 1987

[54] SAND BLASTING NOZZLE

[75] Inventor: Jean Spitz, Chatenois, France

[73] Assignee: Commissariat a l'Energie Atomique, Paris, France

[21] Appl. No.: 475,514

[22] Filed: Mar. 15, 1983

[30] Foreign Application Priority Data

Mar. 15, 1982 [FR] France ..... 82 04336

[51] Int. Cl.[4] ..... B24C 5/04

[52] U.S. Cl. ..... 51/439; 51/321

[58] Field of Search ..... 51/439, 427, 410, 319–321; 239/433

[56] References Cited

U.S. PATENT DOCUMENTS 2,039,938 5/1936 Schultz .
2,524,097 10/1950 Barr et al. .
4,449,332 5/1984 Griffiths ..... 51/439

FOREIGN PATENT DOCUMENTS 49667 8/1888 Fed. Rep. of Germany .
207656 8/1907 Fed. Rep. of Germany .
2218924 10/1973 Fed. Rep. of Germany .
2356561 5/1975 Fed. Rep. of Germany .
505273 7/1920 France .
2369008 10/1976 France .
1510 of 1911 United Kingdom .

*Primary Examiner*—Frederick R. Schmidt
*Assistant Examiner*—Robert A. Rose
*Attorney, Agent, or Firm*—Oblon, Fisher, Spivak, McClelland & Maier

[57] ABSTRACT

Sand blasting nozzle, particularly for the decontamination of radioactive members by means of a jet formed from a mixture of water and abrasive particles.

It comprises an intake device able to produce a flat water jet, having an aperture angle $\alpha$ in the plane of the jet, within a vacuum chamber, a discharge member having in planes perpendicular to the flat jet, two divergent side walls substantially of aperture $\alpha$ and, on either side of the flat jet, two convergent walls forming an angle $\beta$, said discharge member forming an integral part of the vacuum chamber, and the angle $\beta$ being defined in such a way that within the chamber is produced an adequate vacuum to ensure that the flat jet entrains the abrasive particles introduced by a pipe carrying a mixture of gas and abrasive particles.

13 Claims, 3 Drawing Figures

SAND BLASTING NOZZLE

BACKGROUND OF THE INVENTION

The present invention relates to a sand blasting nozzle having a flat jet and containing solid abrasive particles. It more particularly relates to a sand blasting nozzle using water under high or very high pressure for cleaning very dirty surfaces, or surfaces covered with oxides, paint or various deposits. It also relates to a process for using a sand blasting nozzle for radioactive decontamination.

During the operation of nuclear power stations and units for the reprocessing of nuclear fuels, certain elements are exposed to radiation. A thin radioactive film forms on the surface of these elements and this film must be eliminated. This cannot be obtained by using pressurized water alone, because the latter does not make it possible to eliminate oxides. It is therefore conventional practice to use sand blasting devices, which employ high pressure water in which the water jet contains abrasive particles. A sand blasting device of this type comprises an intake device, which produces a jet within a vacuum chamber. A pipe, which supplies a mixture of air and abrasive, also issues into said chamber. The vacuum makes it possible to suck in the abrasive, which is then incorporated into the water of the jet.

Known sand blasting devices of this type are constructed in two different ways.

In the first type, the water is injected along the axis of the sand blasting device and the abrasive supply pipe issues laterally into the vacuum chamber. This construction permits reduced overall dimensions, a simple design and a large concentration of the water jet. However, a disadvantage thereof is that all the mixed air -solid-water jet has an abrasive effect on the discharge nozzle and in order to limit these effects, the nozzle must be made from a mass of a very hard material, such as carbide.

According to a second possible construction, the abrasive particle supply pipe is arranged in the axis of the device and one or more discharge nozzles are positioned laterally with respect to said pipe. Three, four or six nozzles with cylindrical discharge tubes are arranged in annular manner and converge at a point positioned close to the sander outlet. This arrangement offers the advantage of only a slight exposure of the discharge nozzle walls to the action of the abrasive particles, because the mixed jet is not homogeneous. Thus, the particles are essentially concentrated in the center of the jet. Moreover, the impact of the jet on the member to be cleaned is distributed over a larger surface.

However, no matter what constructional mode is envisaged, the known sand blasting devices have a circular path on the member to be cleaned, when its surface is presented perpendicular to the jet and semi-elliptical when the surface is presented at an angle of incidence below 90°. In the latter case, the ejected abrasives have a degressive action which is inversely proportional to the distance between the sander and the treated object and erosion will be greater at the apex of the semi-ellipse.

SUMMARY OF THE INVENTION

The present invention relates to a sand blasting nozzle supplying a flat jet and containing abrasive particles, which permits the cleaning of larger surfaces without requiring the connecting in parallel of several sand blasting devices with a circular jet.

Therefore, the present invention relates to a sand blasting nozzle for the decontamination of radioactive members by means of a jet formed from a mixture of water and abrasive particles, wherein it comprises a known intake device, able to produce a single flat water jet, having an aperture angle $\alpha$ in the plane of the jet, within a vacuum chamber, a discharge member having, in planes perpendicular to the flat jet, two substantially divergent side walls of aperture $\alpha$ and, on either side of the flat jet, two convergent walls forming an angle $\beta$, said discharge member forming an integral part of the vacuum chamber, and the combination of the angles $\alpha$ and $\beta$ and the cross-section of the discharge opening being defined in such a way that in the chamber, there is produced an adequate vacuum entraining the abrasive particles and orienting them in such a way that the bombardment of the walls and the discharge member are non-existent, when the regularity of the abrasive particles is constant.

Moreover, the invention relates to a process for using a sand blasting nozzle for radioactive decontamination, wherein water-soluble abrasive particles are used.

Bearing in mind that this dissolving action is not immediate, said particles are in solid form during the sand-blasting operation, which enables them to fulfil this abrasive function after which they dissolve in the water.

Preferably, these abrasive particles are of boron trioxide. This material, which is converted into acid and swells on contact with water, would a priori appear to be relatively unsuitable for such a use. However, it has been shown that on adopting appropriate process parameters and adaptable structures, it is possible to obtain high flow rates and prevent risks of pipe blockages.

BRIEF DESCRIPTION OF THE DRAWINGS

The invention is described in greater detail hereinafter relative to non-limitative embodiments and the attached drawings, wherein show.

DETAILED DESCRIPTION OF THE INVENTION

Figure 1:
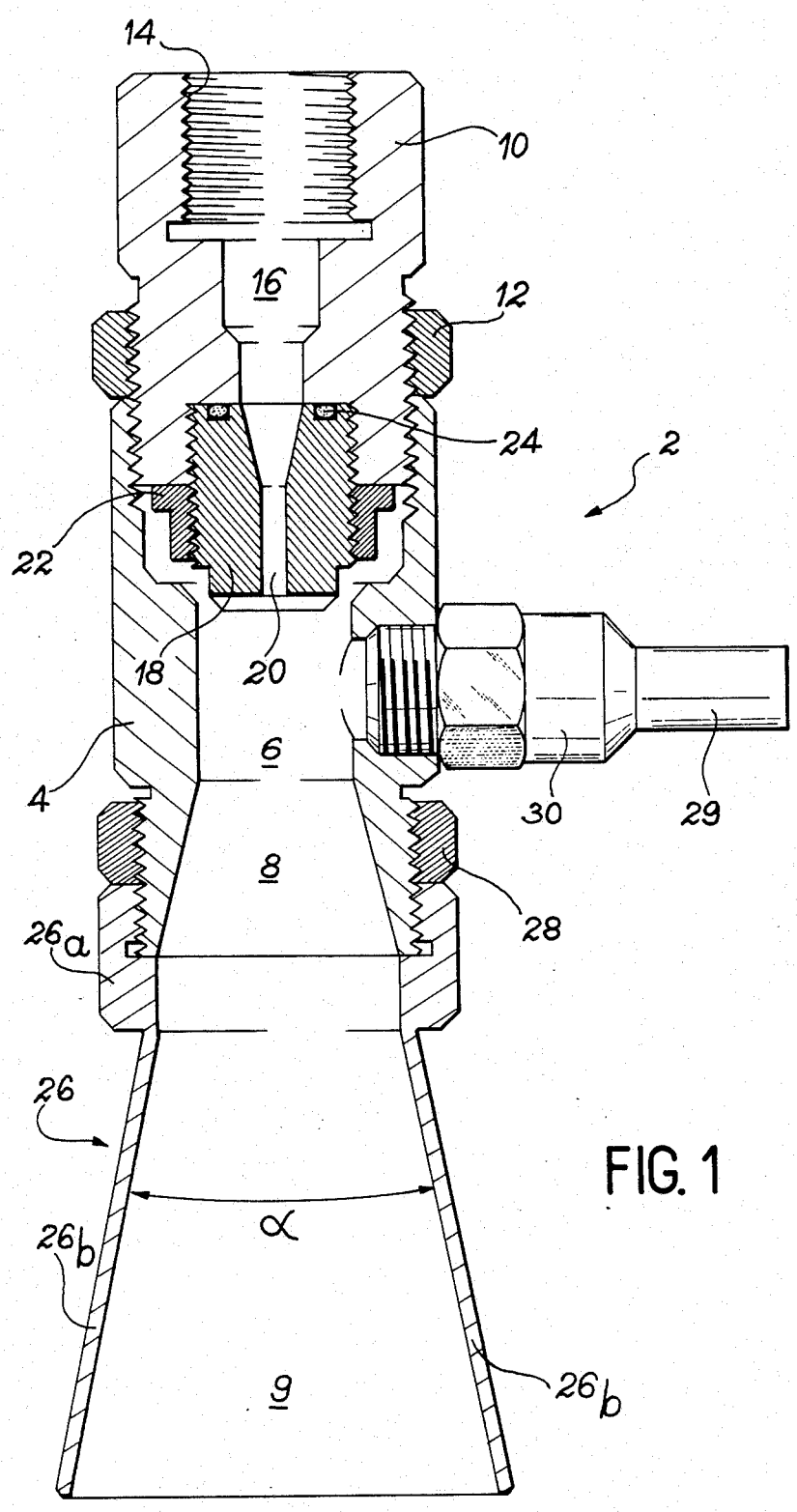
FIG. 1 a sectional view of a first embodiment of the sand blasting device according to the invention, incorporating a single discharge nozzle arranged in axial manner and a lateral abrasive supply means.
Figure 2:
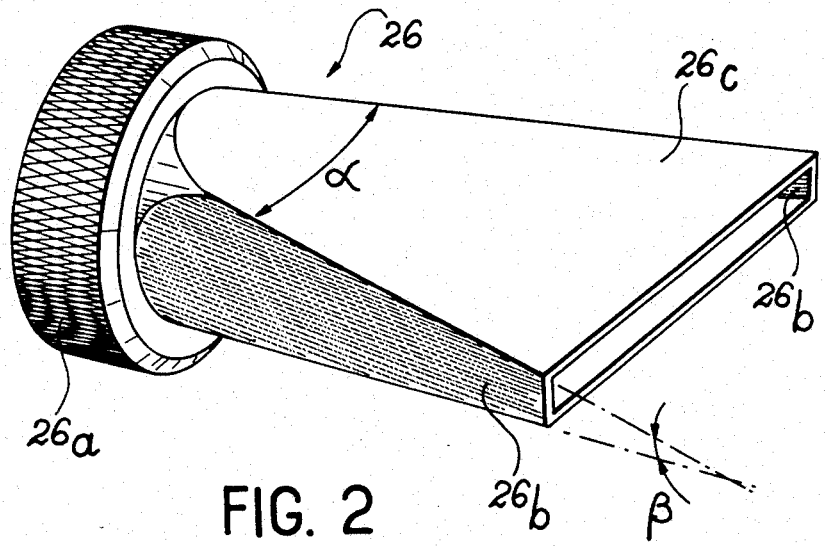
FIG. 2 a perspective view of the discharge nozzle of the device of FIG. 1.

FIGS. 1 and 2 show a first embodiment of a sand blasting nozzle 2 according to the invention. FIG. 1 is a sectional view of the sand blasting nozzle, whilst FIG. 2 is a perspective view of the discharge member forming an integral part of the sand blasting nozzle.

Nozzle 2 comprises a cylindrical body 4, within which there is a circular suction chamber 6 having a cylindrical part, extended by a widening conical part 8. The angle of conical part 8 is approximately equal to the discharge angle of a flat jet discharge nozzle 18. At one of the ends of body 4 is provided an internal thread, into which is screwed the intake unit 10 for the high pressure water. Unit 10 is fixed with respect to body 4 by a lock nut 12. An internal thread 14 makes it possible to connect the coupling of the high pressure water supply pipe (not shown). This pipe supplies water into an inner channel 16, which issues into the discharge nozzle 18, screwed into unit 10. Nozzle 18 has an outlet port 20, whose cross-section is defined in such a way as to produce a flat jet. A discharge nozzle of this type is known, and, for example, SOCOFREN markets discharge nozzles which can be used for the purposes of the invention. The discharge nozzle 18 is screwed onto intake unit 10. A lock nut 22 locks it in rotation with respect to body 10. An O-ring 24 provides the necessary seal between body 10 and discharge nozzle 18.

At the other end of body 4, there is a discharge member 26, which is screwed onto an external thread of body 4 and to this end has a knurled portion 26*a*. It is locked in rotation relative to body 4 by a lock nut 28.

Discharge member 26 has two divergent side walls, substantially of aperture $\alpha$, located in planes perpendicular to the flat jet, and two convergent walls 26*c* forming an angle $\beta$. The interior 9 of discharge member 26 forms an integral part of the vacuum chamber.

Sand blasting device 2 also has a pipe 29 for supplying abrasive particles. Pipe 29 is terminated by a supply connection 30 screwed onto body 4. Connection 30 issues into suction chamber 6. In the embodiment of FIG. 1, the connection 30 is arranged perpendicular to the longitudinal axis of body 4.

The combination of angles $\alpha$ and $\beta$, and the cross-section of discharge member 26 are defined so as to produce a sufficient vacuum in the suction chamber 6 to entrain the abrasive particles and orient them in such a way that the bombardment of the walls of the discharge member 26 are non-existent, when the abrasive particles have a constant regularity. The abrasive particles are introduced by pipe 29 carrying a mixture of gas and abrasive particles, whereby the gas can be air.

Discharge nozzle 18 and discharge member 26 must be positioned angularly with respect to one another, in such a way that the flat jet is aligned with the opening of discharge member 26. This angular position can easily be obtained by lock nuts 22 and 28, which make it possible to respectively block discharge nozzle 18 and discharge member 26 in a random position.

The sand blasting nozzle shown in FIG. 1 functions in the following way. The pressurized water is fed via outlet port 20 of discharge nozzle 18 into the suction chamber 6, creating a vacuum. This vacuum makes it possible to suck into chamber 6 the mixture of air and abrasive particles supplied by pipe 29. The abrasive particles mix with the water jet and mixed jet, i.e. the mixture of air, solid particles and water, traverses discharge member 26. Discharge nozzle 18, of per se known construction, gives a flat jet. The smallest thickness plane of discharge member 26 approximately coincides with the median plane of the flat water jet under high pressure. The interior of discharge member 26 forms an integral part of suction chamber 6.

According to a not shown constructional variant of the sand blasting nozzle of FIG. 1, the intake cross-section of the air - solid particle mixture is increased, whilst bringing about an intake of said mixture parallel to the axis of body 4. To this end, a supplementary member having a cavity forming an elbow or bend makes it possible to install a mixture intake coupling. The member is fixed, e.g. by screws, to body 4. The joined member has a long resistance to wear by abrasion in the elbow, due to the thickness of its walls.

Figure 3:
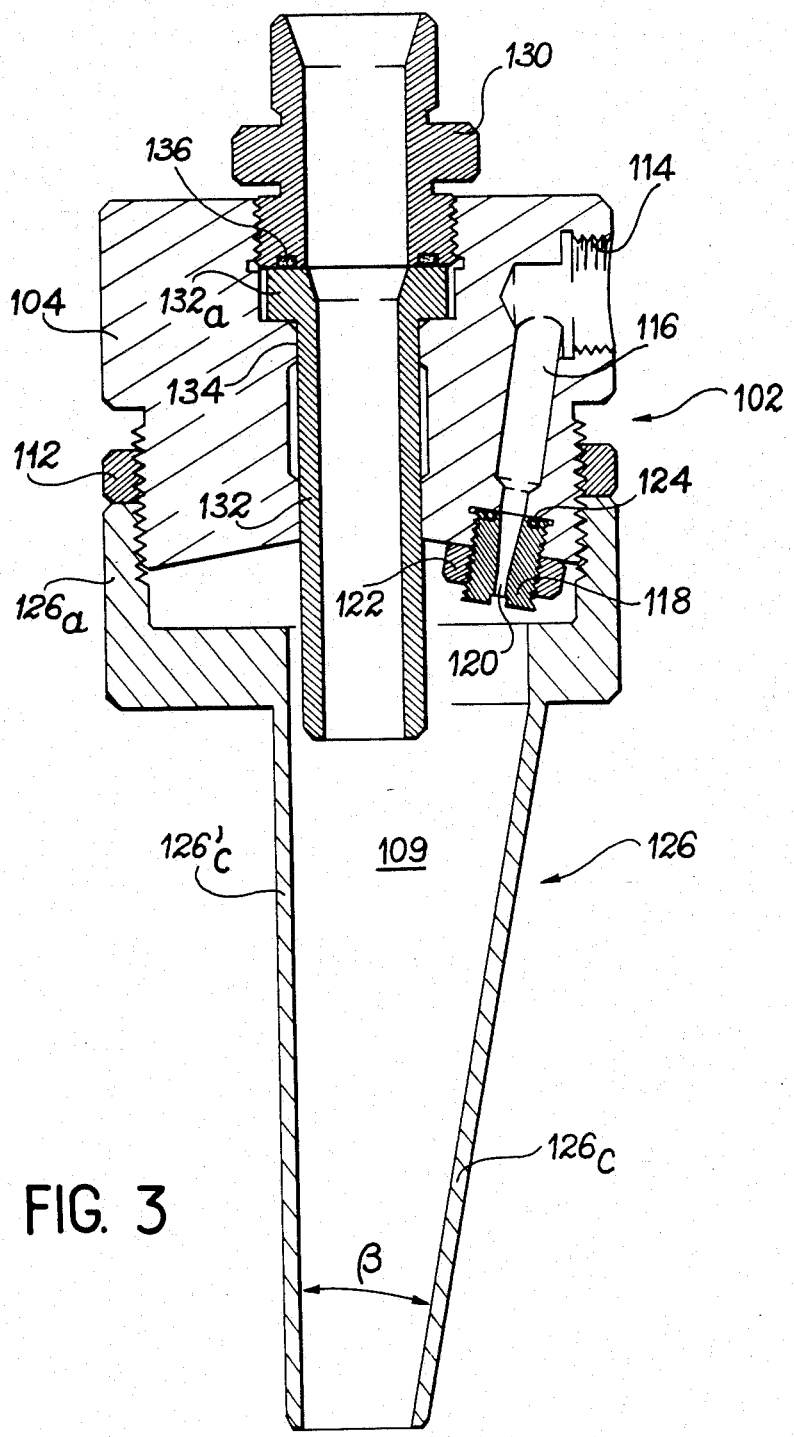
FIG. 3 a second embodiment of the sand blasting device according to the invention, incorporating an axial abrasive supply means and a single, laterally positioned discharge nozzle.

FIG. 3 shows a second improved embodiment of the sand blasting device according to the invention. Sand blasting nozzle 102 differs from sand blasting nozzle 2 of FIG. 1 in that the supply pipe for the mixture of air and abrasive particles is disposed in the axis of body 104, whilst the single discharge nozzle 118 is positioned laterally of said pipe. In FIG. 3, the members which have the same function as that of nozzle 2 of FIG. 1 are designated by the same reference numerals, increased by 100. Thus, they will not be described again in detail.

In the case of nozzle 102, the angle formed by the median plane of the flat water jet supplied by outlet port 120 and the axis of the supply pipe of the air - solid particle mixture must be as small as possible.

The water under high pressure is supplied by the cylindrical body 104. The supply pipe (not shown) is fixed into body 104 on thread 114. A duct 116 supplies water under high pressure to discharge nozzle 118, screwed into body 104. A lock nut 122 permits the positioning in rotation of discharge nozzle 118. Thus, this nozzle can be positioned in such a way that the longitudinal axis of the outlet port 120 is aligned with the opening of discharge member 126. The angular position of discharge nozzle 118 can be regulated by lock nut 122.

It should be noted that in this embodiment, the suction chamber is essentially constituted by the interior of discharge member 126.

The supply connection 130 for the mixture of air and abrasive particles is screwed into the axis of body 104. An insert 132 arranged in a bore 134 of body 104 carries the air - abrasive particle mixture until it meets the high pressurized water jet. An O-ring 136 provides a tight connection between supply connection 130 and insert 132. It should be noted that supply connection 130 is applied directly to flange 132*a* of insert 132, when this is cylindrical.

The walls 126*b* (not shown, but perpendicular to the plane of the page) of discharge member 126 is essentially perpendicular to the median plane of the flat jet from discharge nozzle 118. Wall 126*c* is essentially parallel to the median plane of the flat jet from discharge nozzle 118, while wall 126'*c* is substantially parallel to the axis of the air -abrasive particle mixture from insert 132.

The embodiment of FIG. 3 offers a double advantage. The air - abrasive particle mixture is supplied axially without a pressure drop and whilst taking acount of the initial velocity of the mixture. Moreover, the angle between the axis of the air - abrasive particle mixture supply pipe and the water jet axis is small (less than 15°), so that there is no risk of blockages. Moreover, the axial intake of the air - solid mixture makes it possible to use a forced supply by compressed air, which increases the possibilities of transporting the abrasive particles, as well as the discharge velocity of the final air - water -solid particle mixture.

The sand blasting nozzle according to the invention has been designed so as to prevent to the maximum possible extent all the risks of blockages. The latter are particularly great when the solid abrasive used is a soluble abrasive, such as boron trioxide $B_2O_3$, which is of particular interest in radioactive decontamination.

Thus, in the case of known sand blasting processes, the abrasive particles mix with the contaminated particles from the thin layer existing on the contaminated part. This has the effect of increasing the cost of conditioning and storing these effluents.

When, according to the process for using a sand blasting nozzle according to the invention, use is made of a water-soluble abrasive, the abrasive particles are in solid form during the sand blasting operation, which makes it possible for them to fulfil their abrasive function. However, after they have performed their abrasive function, they then dissolve in the water. This makes it possible to separate by filtering the metal particles resulting from the removal of the contaminated layer and the water containing the abrasive particles which have been dissolved. The metal or other solid particles are treated, then conditioned and stored. The effluents are treated prior to their rejection by a possible recycling process.

Finally, it is considered that the hydrophilic nature of the abrasive particles used plays an important part in the satisfactory operation of a sand blasting nozzle according to the invention. Thus, it would seem that the particles surround the fine wear droplets which, combined with the particular shape of the nozzle referred to hereinbefore, lead to the absence of wear with respect to discharge member 26, as has become apparent during the testing period.

What is claimed is:

1. A nozzle for the mixture of an incompressible propellant fluid and a mixture of a compressible fluid and abrasive particles, said nozzle comprising:

(a) a body having a distal end and a proximal end, said body containing a first bore leading from the distal end to the proximal end of said body, the distal end of said first bore constituting a suction chamber;

(b) an intake unit for an incompressible propellant fluid attached to the proximal end of said body, said intake unit having a second bore which has a distal end and a proximal end, the distal end of said second bore terminating in an outlet port sized, shaped, and positioned so as to produce a flat, divergent jet of incompressible propellant fluid centrally located in said suction chamber, the discharge angle of the flat, divergent jet of incompressible propellant fluid produced by said outlet port being such that and said outlet portion and said suction chamber being sized, shaped, and positioned so that the flat, divergent jet of incompressible propellant fluid produced by said outlet port does not contact said body;

(c) a supply connection for a mixture of a compressible fluid and abrasive particles attached to said body, said supply connection being in fluid communication with said suction chamber; and (d) a discharge member attached to the distal end of said body, said discharge member containing an interior volume defined by two divergent walls and two convergent walls, said interior volume having a proximal end which is in fluid communication with the distal end of said first bore and a distal end which is open to the exterior of the nozzle, said two divergent walls being at least approximately perpendicular to the flat, divergent jet of incompressible fluid produced by said outlet port and diverging toward the distal end of said interior volume by an angle $\alpha$ which is at least approximately equal to the angle by which the flat, divergent jet of incompressible fluid produced by said outlet port diverges, each of said two convergent walls connecting said two divergent walls at opposite ends thereof and converging toward the distal end of said interior volume by an angle $\beta$, the angles $\alpha$ and $\beta$ being selected and said interior volume being sized and shaped so as to produce a vacuum in said suction chamber which draws the mixture of compressible fluid and abrasive particles into said suction chamber, where they are entrained in the incompressible propellant fluid, and so that the flat, divergent jet of incompressible fluid produced by said outlet port does not contact said discharge member.

2. A nozzle for the mixture of an incompressible propellant fluid and a mixture of a compressible fluid and abrasive particles, said nozzle comprising:

(a) a body having a distal end and a proximal end, said body containing a first bore leading from the distal end to the proximal end of said body;

(b) a discharge nozzle for an incompressible propellant fluid attached to the distal end of said body, said discharge nozzle having an outlet port sized, shaped, and positioned so as to produce a flat, divergent jet of incompressible propellant fluid;

(c) a discharge member attached to the distal end of said body, said discharge member containing an interior volume defined by two divergent walls and two convergent walls, said interior volume having a proximal end which is in fluid communication with said outlet port and a distal end which is open to the exterior of the nozzle, said two divergent walls being at least approximately perpendicular to the flat, divergent jet of incompressible fluid produced by said outlet port and diverging toward the distal end of said interior volume by an angle $\alpha$ which is at least approximately equal to the angle by which the flat, divergent jet of incompressible fluid produced by said outlet port diverges, said two convergent walls connecting said two divergent walls at opposite ends thereof and converging toward the distal end of said interior volume; and (d) a supply connection for a mixture of a compressible fluid and abrasive particles received in said first bore, said supply connection being in fluid communication with said interior volume, which is sized and shaped so as to produce a vacuum therein which draws the mixture of compressible fluid and abrasive particles into said interior volume, where they are entrained in the incompressible propellant fluid, and so that the flat, divergent jet of incompressible fluid produced by said outlet port does not contact said discharge member.

3. A nozzle for the mixture of a incompressible propellant fluid and a mixture of a compressible fluid and abrasive particles, said nozzle comprising:

(a) a body having a distal end and a proximal end, said body containing a first bore leading from the distal end to the proximal end of said body, the distal end of said first bore constituting a suction chamber the proximal portion of which is cylindrical in shape and the distal portion of which is conical in shape and diverges to the distal end of said body, the proximal end of a conical portion of said suction chamber connecting smoothly with the distal end of the cylindrical portion;

(b) an intake unit for an incompressible propellant fluid attached to the proximal end of said body, said intake unit having a second bore which has a distal end and a proximal end, the distal end of said second bore terminating in an outlet port sized, shaped, and positioned so as to produce a flat, divergent jet of incompressible propellant fluid centrally located in the cylindrical portion of said suction chamber, the discharge angle of the flat, divergent jet of incompressible propellant fluid produced by said outlet port being at least approximately equal to the angle by which the conical portion of said suction chamber diverges from the cylindrical portion and said outlet port and said suction chamber being sized, shaped, and positioned so that the flat, divergent jet of incompressible propellant fluid produced by said outlet port does not contact said body;

(c) a supply connection for a mixture of a compressible fluid and abrasive particles attached to said body, said supply connection being in fluid communication with said suction chamber; and (d) a discharge member attached to the distal end of said body, said discharge member containing an interior volume defined by two divergent walls and two convergent walls, said interior volume having a proximal end which is in fluid communication with the distal end of said first bore and a distal end which is open to the exterior of the nozzle, said two divergent walls being at least approximately perpendicular to the flat, divergent jet of incompressible fluid produced by said outlet port and diverging toward the distal end of said interior volume by an angle $\alpha$ which is at least approximately equal to the angle by which the flat, divergent jet of incompressible fluid produced by said outlet port diverges, each of said two convergent walls connecting said two divergent walls at opposite ends thereof and converging toward the distal end of said interior volume by an angle $\beta$, the angles $\alpha$ and $\beta$ being selected and said interior volume being sized and shaped so as to produce a vacuum in said suction chamber which draws the mixture of compressible fluid and abrasive particles into said suction chamber, where they are entrained in the incompressible propellant fluid, and so that the flat, divergent jet of incompressible fluid produced by said outlet port does not contact said discharge member.

4. A nozzle as recited in claim 3 wherein said intake unit is threadedly attached to the proximal end of said body.

5. A nozzle as recited in claim 3 wherein said discharge member is threadedly attached to the distal end of said body.

6. A nozzle as recited in claim 3 wherein said supply connection is threadedly attached to said body.

7. A nozzle as recited in claim 3 wherein said supply connection is in fluid communication with the cylindrical portion of said suction chamber.

8. A nozzle as recited in claim 3 wherein said supply connection is shaped so that the mixture of a compressible fluid and abrasive particles is introduced into said suction chamber in a direction which is in the plane of the flat, divergent jet of incompressible propellant fluid produced by said outlet port and perpendicular to the direction of the jet.

9. A nozzle for the mixture of an incompressible propellant fluid and a mixture of a compressible fluid and abrasive particles, said nozzle comprising:

(a) a body having a distal end and a proximal end, said body containing a first bore leading from the distal end to the proximal end of said body;

(b) a discharge nozzle for an incompressible propellant fluid attached to the distal end of said body, said discharge nozzle having an outlet port sized, shaped, and positioned so as to produce a flat, divergent jet of incompressible propellant fluid;

(c) a discharge member attached to the distal end of said body, said discharge member containing an interior volume defined by two divergent walls and two convergent walls, said interior volume having a proximal end which is in fluid communication with said outlet port and a distal end which is open to the exterior of the nozzle, said two divergent walls being at least approximately perpendicular to the flat, divergent jet of incompressible fluid produced by said outlet port and diverging toward the distal end of said interior volume by an angle $\alpha$ which is at least approximately equal to the angle by which the flat, divergent jet of incompressible fluid produced by said outlet port diverges, said two convergent walls connecting said two divergent walls at opposite ends thereof and converging toward the distal end of said interior volume by an angle $\beta$ of less than 15°; and (d) a supply connection for a mixture of a compressible fluid and abrasive particles received in said first bore, said supply connection being in fluid communication with said interior volume, which is sized and shaped so as to produce a vacuum therein which draws the mixture of compressible fluid and abrasive particles into said interior volume, where they are entrained in the incompressible propellant fluid, and so that the flat, divergent jet of incompressible fluid produced by said outlet port does not contact said discharge member.

10. A nozzle as recited in claim 9 wherein said discharge nozzle is threadedly attached to the distal end of said body.

11. A nozzle as recited in claim 9 wherein said discharge member is threadedly attached to the distal end of said body.

12. A nozzle as recited in claim 9 wherein said supply connection is threadedly received in said first bore.

13. A nozzle as recited in claim 9 wherein said supply connection is shaped so that the mixture of a compressible fluid and abrasive particles is introduced into said interior volume in a stream which intersects the flat, divergent jet of incompressible fluid produced by said outlet port at the angle $\beta$.

* * * * *